US007645149B2

(12) United States Patent
Carbone et al.

(10) Patent No.: US 7,645,149 B2
(45) Date of Patent: Jan. 12, 2010

(54) TAMPER RESISTANT ASSEMBLY FOR AN ELECTRICAL RECEPTACLE

(75) Inventors: Christopher A. Carbone, Newton, CT (US); Sorin I. Mortun, Irvington, NY (US); Anthony Melito, Shelton, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 12/078,719

(22) Filed: Apr. 3, 2008

(65) Prior Publication Data

US 2009/0227131 A1 Sep. 10, 2009

Related U.S. Application Data

(63) Continuation-in-part of application No. 12/073,694, filed on Mar. 7, 2008.

(51) Int. Cl.
*H01R 439/137* (2006.01)

(52) U.S. Cl. ..... 439/137

(58) Field of Classification Search ..... 439/140, 439/134–139, 145, 149, 113, 345, 373; 174/67, 174/53

See application file for complete search history.

(56) References Cited

U.S. PATENT DOCUMENTS 2,545,536 A * 3/1951 Von Holtz ..... 439/137
3,990,758 A 11/1976 Petterson
4,379,607 A 4/1983 Bowden, Jr.
4,544,219 A 10/1985 Barkas
4,867,694 A 9/1989 Short
5,006,075 A 4/1991 Bowden, Jr.
5,915,981 A 6/1999 Mehta
6,217,353 B1 4/2001 Yu-Tse
6,422,880 B1 7/2002 Chiu
6,555,771 B2 4/2003 Shao
6,786,744 B1 9/2004 Lee
6,786,745 B1 * 9/2004 Huang ..... 439/137
6,893,275 B2 5/2005 Ng
6,932,631 B2 8/2005 Huang

* cited by examiner

*Primary Examiner*—Alexander Gilman
(74) *Attorney, Agent, or Firm*—Alfred N. Goodman; Mark S. Bicks; Marcus R. Mickney

(57) ABSTRACT

An electrical receptacle includes a front cover having a rib and a protrusion connected thereto, a back housing secured to the front cover and a tamper resistant assembly disposed between the front cover and the back housing. The tamper resistant assembly includes a slide pad member, first and second shutter members, a first spring disposed between and biasing the first and second shutter members toward closed positions thereof, and a second spring disposed between and biasing the first shutter member away from the front cover. The slide pad member is connected to the back housing. The first shutter member is slidably disposed on the slide pad member and has first and second arms extending from a first cam surface. A second shutter member is slidably disposed on the slide pad member and has a blocking body connected to a second cam surface. The first and second shutter members are movable between open and closed positions.

17 Claims, 12 Drawing Sheets

FIG. 1
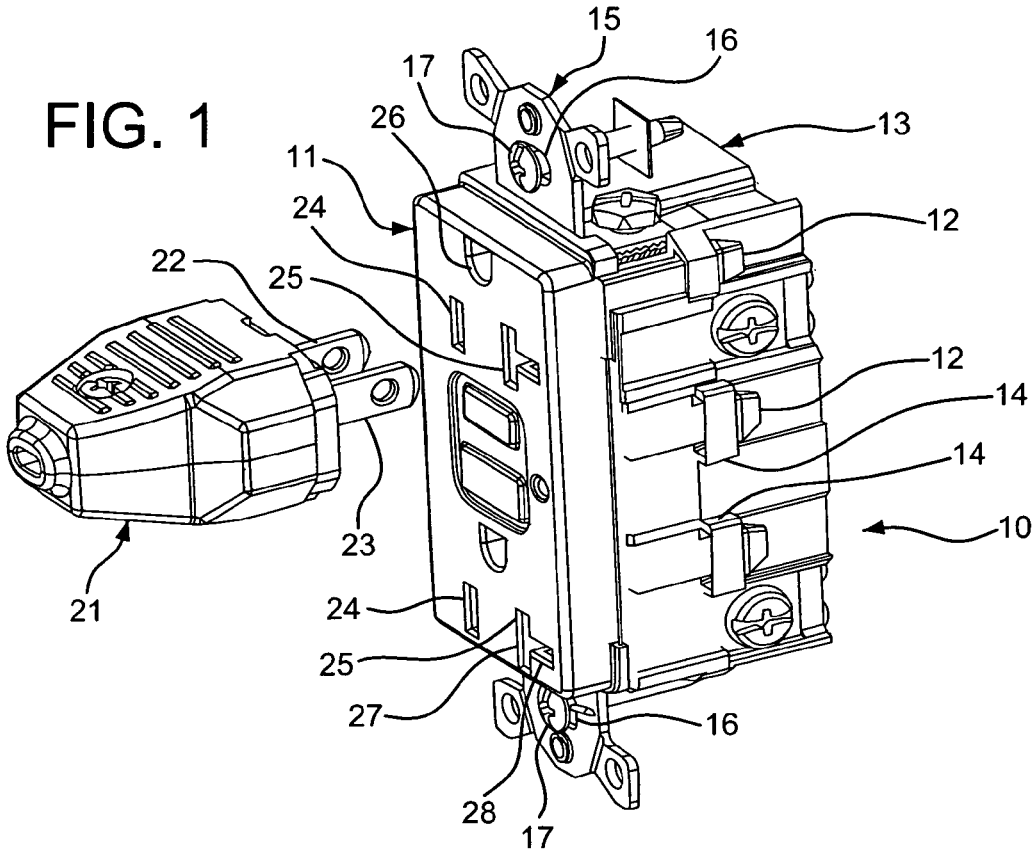
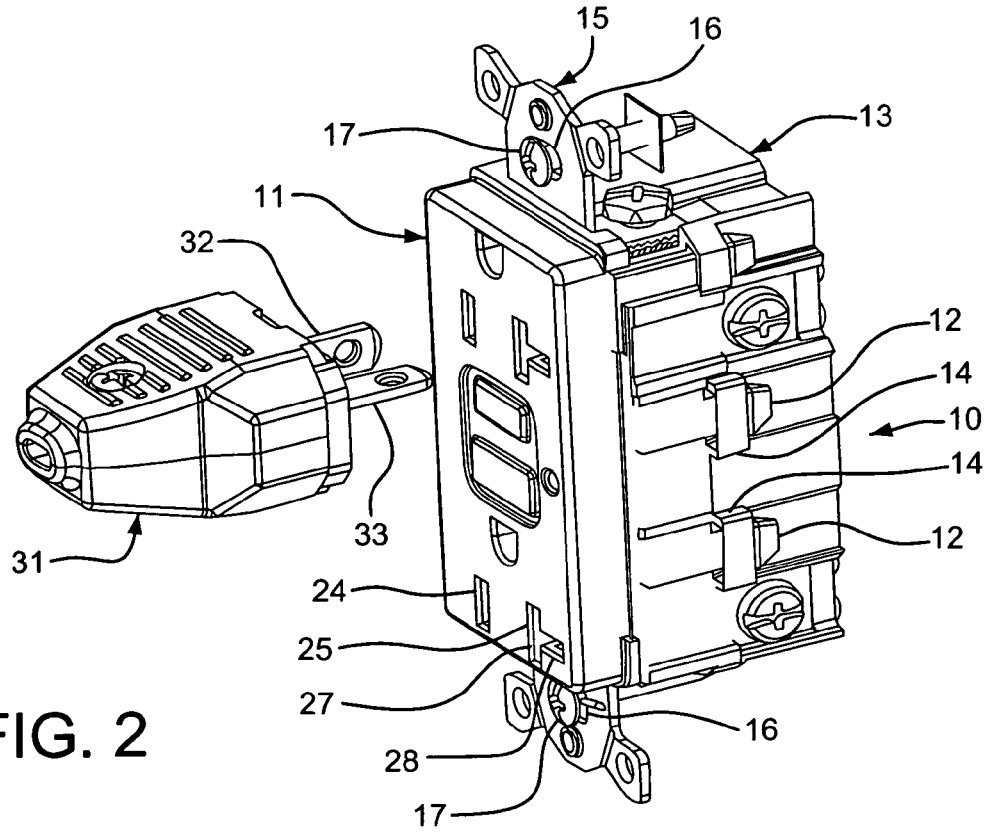
FIG. 2

TAMPER RESISTANT ASSEMBLY FOR AN ELECTRICAL RECEPTACLE

CROSS REFERENCE TO RELATED APPLICATION

This is a continuation-in-part application of patent application Ser. No. 12/073,694, filed Mar. 7, 2008, which is hereby incorporated by reference in its entirety.

FIELD OF THE INVENTION

The present invention relates to a tamper resistant assembly for an electrical receptacle. More particularly, the present invention relates to a tamper resistant electrical receptacle adapted to receive both 15 and 20 amp plugs. Still more particularly, the present invention relates to a tamper resistant assembly for an electrical receptacle in which a first arm of a first shutter member of the tamper resistant assembly has a semi-living hinge and pivotal movement of a second arm of the first shutter member is substantially prevented by a stop on a front cover of the electrical receptacle.

BACKGROUND OF THE INVENTION

A group of electrical receptacles is referred to as "protective" receptacles because some measure has been taken in the construction to protect children and others from harm if they should intentionally or inadvertently insert or attempt to insert an electrically conductive article into the electrically energized portions of the receptacle. Conventional electrical receptacles have a nonconductive face portion with openings to receive plug blades. In normal use, the blades pass through the nonconductive space and are received by conductive female elements that are connected to line voltage. A child inserting, for example, a paper clip or the conductive portion of a toy into the energized conductive elements can be seriously injured.

To avoid this danger, "shuttered" receptacles resist insertion and electrical connection of anything other than the two blades of an appropriate plug by elements provided between the faceplate and the conductive elements. The electrical energization of internal components is not controlled; rather, access to those conductive elements is prevented except under a defined set of circumstances.

An example of a shuttered receptacle is found in U.S. Pat. No. 4,379,607 to Bowden, Jr. (the Bowden '607 patent), the subject matter of which is hereby incorporated by reference. The Bowden '607 patent discloses two identical slideable shutter members 56 provided behind the slots 70 in the cover 54 and in front of the terminals 68 within the receptacle base 52, as shown in FIGS. 1, 2 and 7. Each of the two identical shutter members has a cam surface 108 and a blocking portion 106. The cam surfaces 108 are positioned so that each one is contacted by a blade and is caused to move so that its blocking portion unblocks the slot for the other blade. Thus, when the two blades are concurrently inserted, they act against the two cam surfaces and unblock each other's passageways.

While this structure appears to be quite suitable for its intended purpose, and while it does have the advantage of permitting the use of shuttering in a grounded plug and receptacle, the design is such that it can only be used with plugs having parallel blades, such as type 1-15 P and 5-15 P.

As is well known, however, plugs and receptacles used in the home as well as in offices and other circumstances at the present time include configurations, such as 20 amp plugs, in which the plug blades are perpendicular to each other rather than being parallel (as in 15 amp plugs). Electrical receptacles are generally configured to be able to receive both 15 and 20 amp plugs. The slideable shutter members of the Bowden '607 patent do not provide tamper resistance for an electrical receptacle adapted to receive both 15 and 20 amp plugs.

Thus, there is a continuing need to provide improved tamper resistant assemblies for electrical receptacles adapted to receive both 15 and 20 amp plugs.

SUMMARY OF THE INVENTION

Accordingly, it is a primary objective of the present invention to provide an improved tamper resistant assembly for an electrical receptacle.

A further objective of the present invention is to provide an improved tamper resistant assembly for an electrical receptacle adapted to receive both 15 and 20 amp plugs.

A still further objective of the present invention is to provide an improved tamper resistant receptacle adapted to receive both 15 and 20 amp plugs.

Another objective of the present invention is to provide a spring to bias a pivoted shutter arm to prolong the life thereof.

Yet another objective of the present invention is to provide a shutter member with a semi-living hinge to remove the stress element from the pivoted spring arm.

The foregoing objectives are basically attained by a tamper resistant assembly adapted to receive both 15 and 20 amp plugs. A first shutter member is slidably disposed on a slide pad member and has first and second arms extending from a first cam surface. The first arm of the first shutter member is resilient. A second shutter member is slidably disposed on the slide pad member and has a blocking body connected to a second cam surface. The first and second shutter members are movable between open and closed positions. A first spring is disposed between and biases the first and second shutter members toward closed positions thereof.

The foregoing objectives are also basically attained by an electrical receptacle adapted to receive both 15 and 20 amp plugs and having a tamper resistant assembly disposed therein. The electrical receptacle includes a front cover having a rib connected thereto, a back housing secured to the front cover and the tamper resistant assembly disposed between the front cover and the back housing. The tamper resistant assembly includes a slide pad member, first and second shutter members, a first spring disposed between and biasing the first and second shutter members toward closed positions thereof, and a second spring disposed between and biasing the first shutter member away from the front cover. The slide pad member is connected to the back housing. The first shutter member is slidably disposed on the slide pad member and has first and second arms extending from a first cam surface. A second shutter member is slidably disposed on the slide pad member and has a blocking body connected to a second cam surface. The first and second shutter members are movable between open and closed positions.

Other objects, advantages and salient features of the invention will become apparent from the following detailed description, which, taken in conjunction with the annexed drawings, discloses a preferred embodiment of the invention.

As used in this application, the terms "front," "rear," "upper," "lower," "upwardly," "downwardly," and other orientational descriptors are intended to facilitate the description of the tamper resistant electrical receptacle, and are not intended to limit the structure of the tamper resistant electrical receptacle to any particular position or orientation.

BRIEF DESCRIPTION OF THE DRAWINGS

The above aspects and features of the present invention will be more apparent from the description for an exemplary embodiment of the present invention taken with reference to the accompanying drawings, in which:

FIGS. 1 and 2 are perspective views of an assembled electrical receptacle including a tamper resistant assembly according to an exemplary embodiment of the present invention about to receive 15 and 20 amp plugs, respectively;

Throughout the drawings, like reference numerals will be understood to refer to like parts, components and structures.

DETAILED DESCRIPTION OF EXEMPLARY EMBODIMENTS

As shown in FIGS. 1-18, the present invention includes a tamper resistant electrical receptacle 10, such as a GFCI. A tamper resistant assembly provides tamper resistance for an electrical receptacle 10 adapted to receive both 15 and 20 amp plugs.

Figure 15:
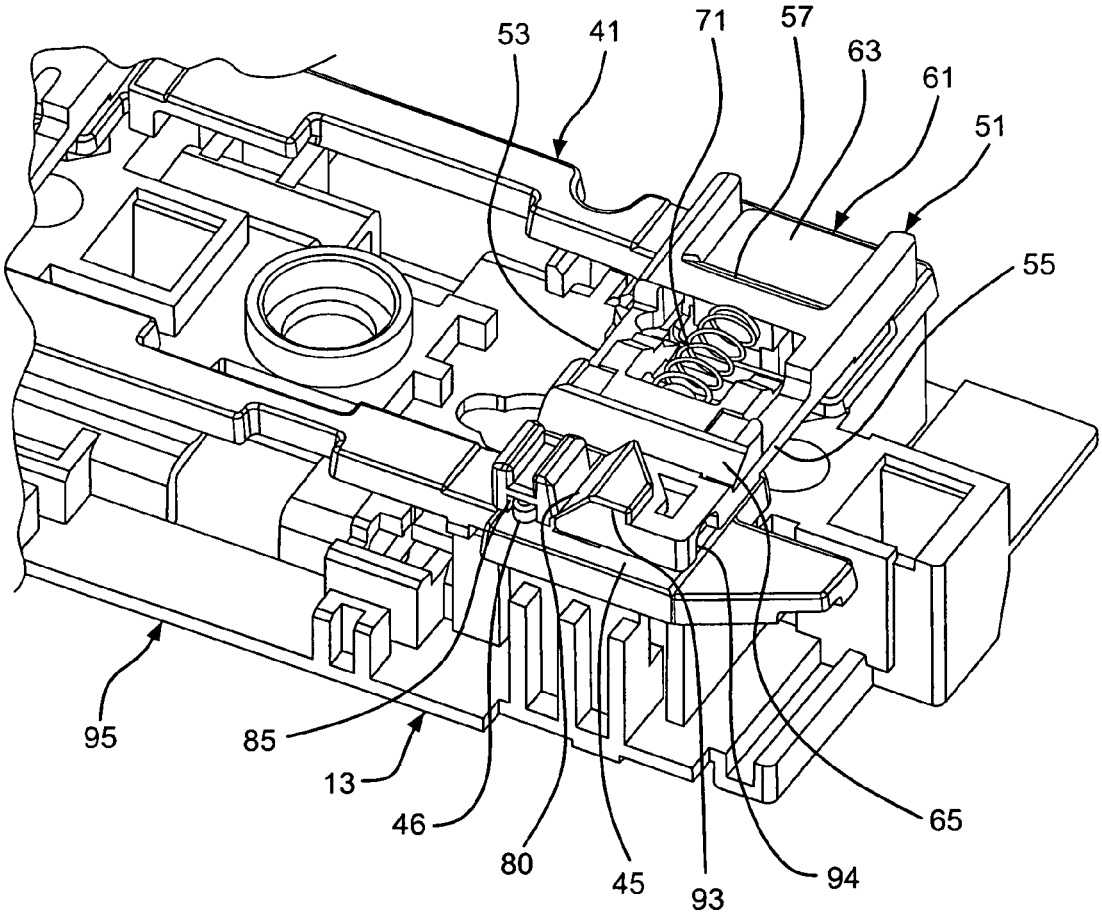
FIG. 15 is a front perspective view of the tamper resistant assembly of the present invention disposed on the barrier housing of an electrical receptacle with the front cover removed for clarity.
Figure 16:
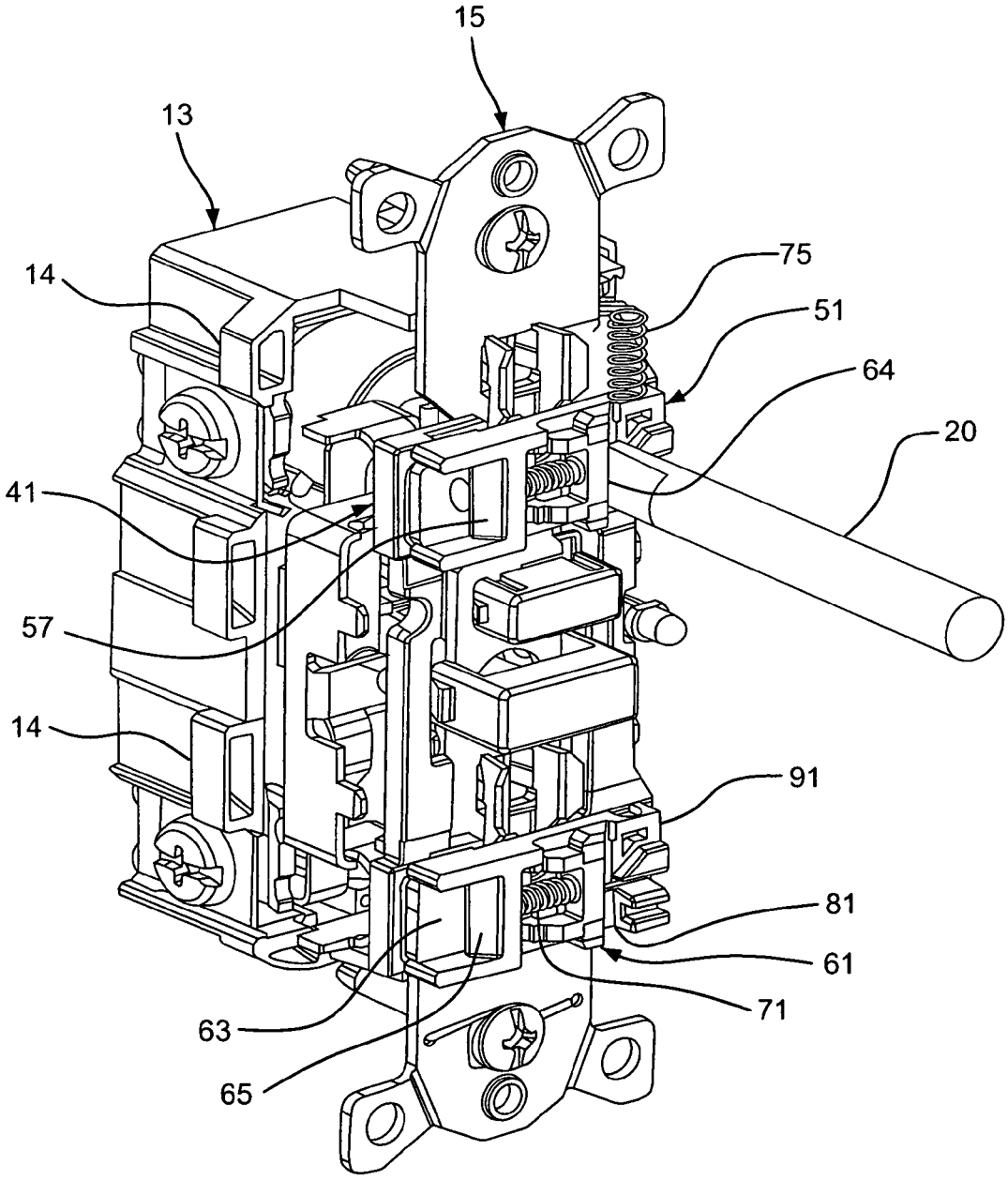
FIG. 16 is a front perspective view of a foreign objected being prevented from accessing an electrical contact by tamper resistant assembly in which the front cover has been removed for clarity.

The tamper resistant assembly, as shown in FIGS. 3-8, 11 and 12, includes a slide pad member 41, a first shutter member 51, a second shutter member 61 and a first spring 33 disposed therebetween. The first shutter member 51 (FIGS. 3 and 4) is slidably disposed on the slide pad member 41, as shown in FIGS. 15 and 16, and has a first arm 53 and a second arm 55 extending from a first cam body 56 having a first cam surface 57. The first arm 53 of the first shutter member 51 is resilient. A second shutter member 61 (FIGS. 5 and 6) is slidably disposed on the slide pad member 41, as shown in FIGS. 15 and 16, and has a blocking body 63 connected to a second cam body 64 having a second cam surface 65. The first and second shutter members 51 and 61 are movable between closed and open positions. A first spring 71 is disposed between the first and second shutter members, as shown in FIGS. 11, 12, 15 and 16.

Figure 14:
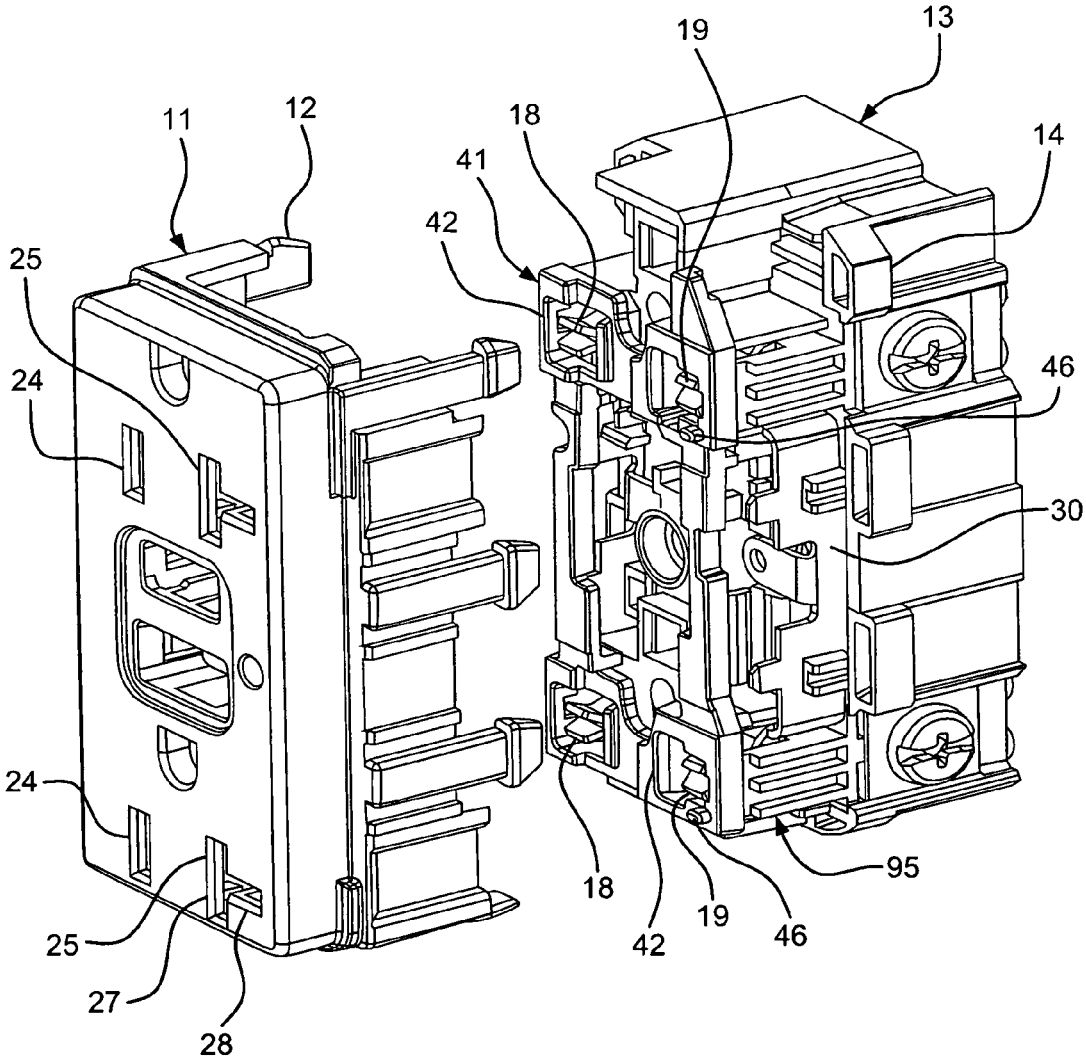
FIG. 14 is a perspective view of the front cover of an electrical receptacle of FIGS. 1 and 2 in which the shutter assembly is disposed prior to engagement with a back housing in which the slide pad member is disposed.

The electrical receptacle 10 has a front cover 11 connected to a back housing 13 with a ground strap 15 connected thereto, as shown in FIGS. 1 and 2. The ground strap 15 has openings 16 disposed at opposite ends adapted to receive fasteners 17 to connect the electrical receptacle 10 to an electrical box (not shown). The ground strap 15 may be disposed between the front cover 11 and the back housing 13 as shown in FIGS. 1 and 2, or may, alternatively, extend around a rear surface of the back housing 15. A plurality of arms 12 extend rearwardly from the front cover 11 and are received by receptacles 14 of the back housing 13 to connect the front cover to the back housing. Conductive elements 18 and 19, as shown in FIG. 14, are disposed within the back housing 13 to receive and make electrical contact with inserted blades of an electrical plug. As best shown in FIG. 14, the back housing 13 has relatively thick and sturdy side walls and has interior recesses adapted to receive upper ends of the conductive elements 18 and 19 of the electrical receptacle.

The front cover 11 has openings suitably disposed to receive the prongs and blades of a conventional male plug. The electrical receptacle 10 shown in FIGS. 1, 2 and 14 is a 15/20 Amp GFCI duplex electrical receptacle, although the present invention is not limited thereto. A first opening 24 and a second opening 25 are disposed in the front cover 11 to receive the blades that form part of the power circuit for the appliance being connected thereto. A third opening 26 receives the ground prong 34 (FIG. 17) of a grounded three-prong connector. The first opening 24 is substantially rectangular in shape and the second opening 25 is substantially T-shaped. The second opening 25 may receive a planar plug blade that is in a plane either substantially parallel to the plane of the planar blade passing through the first opening 24, or that is substantially perpendicular to the blade passing through the first opening. The second opening 25 has a first portion 27 substantially parallel to the first opening 24 and a second portion 28 substantially perpendicular to the first opening 24 (as well as being substantially perpendicular to the first portion 27 of the second opening 25).

A plug 21 in which the two planar blades 22 and 23 passing through the first and second openings 24 and 25 are in substantially parallel planes is referred to as a parallel blade plug, such as a 15 amp plug shown in FIG. 1. A plug 31 that has the planar blade 33 passing through the second opening 25 disposed in a plane substantially perpendicular to the plane in which the blade 32 passing through the first opening 24 is an orthogonal blade plug, such as a 20 amp plug shown in FIG. 2. The ground prong 34 (FIG. 17) is typically substantially D-shaped in cross-section, and is generally longer than the blades passing through the first and second openings 24 and 25. However, the tamper resistant assembly of the exemplary embodiment of the present invention shown and described herein does not interfere with the presence of such a grounding plug, as shown in FIG. 17.

Figure 3:
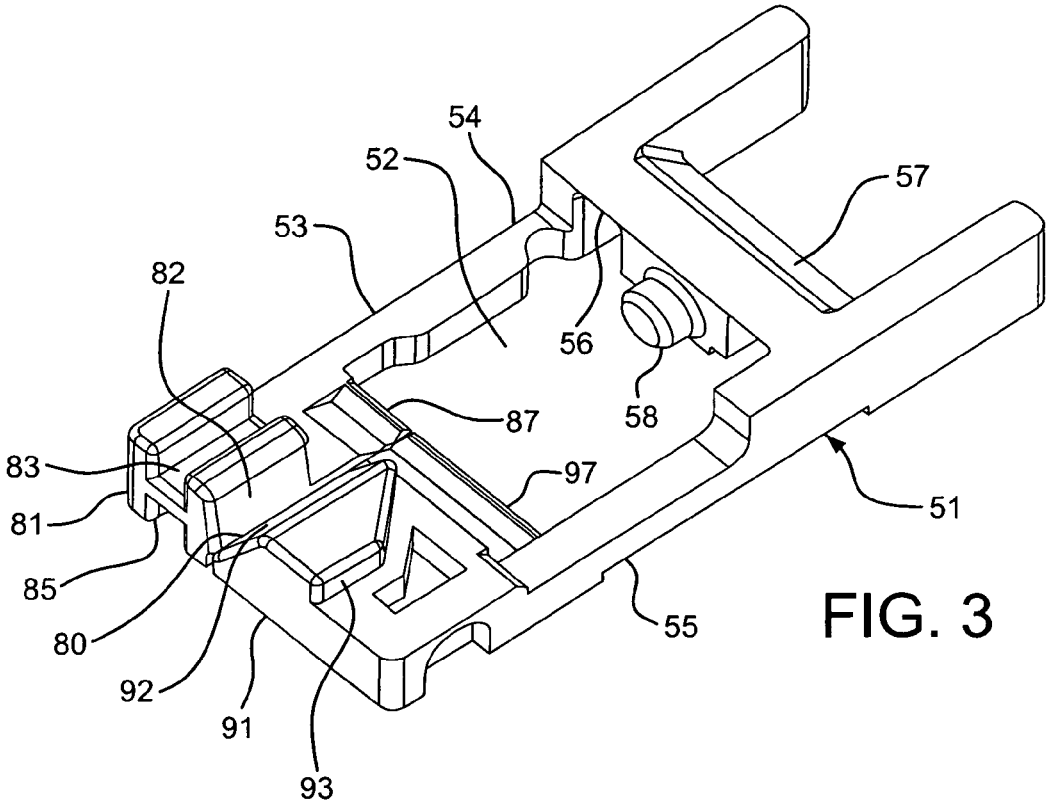
FIGS. 3 and 4 are upper and lower perspective views, respectively, of a first shutter member of a tamper resistant assembly according to an exemplary embodiment of the present invention.
Figure 4:
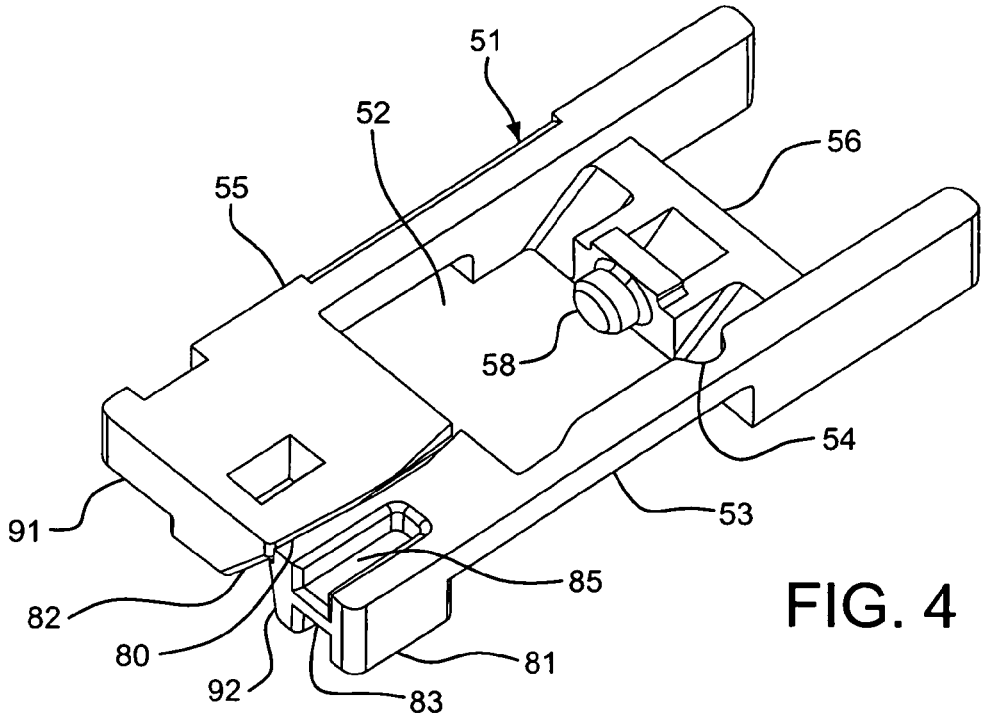

As shown in FIGS. 3 and 4, the first shutter member 51 has at one end thereof a first cam body 56 having a first cam surface 57, which is inclined and faces toward the first opening 24 in the front cover 11 of the electrical receptacle 10 through which a plug blade is inserted. First and second arms 53 and 55 extend outwardly from the first cam body 56. The distal ends 81 and 91 of the first and second arms 53 and 55 have first and second blocking portions 87 and 87 that form a blocking portion positioned below the second opening 25 to prevent a foreign object or a single plug blade inserted therethrough from contacting the electrical contact 19. The cam surface 57 faces away from the blocking body formed by the ends of the first and second arms 53 and 55. The cam body 56 and the first and second arms 53 and 55 define an opening 52, which is preferably substantially rectangular. A generally cylindrical guide rod 58 extends outwardly from the cam body 53 toward the distal ends 81 and 91 of the first and second arms 53 and 55 and is adapted to receive an end 73 of a compression coil spring 71, which urges the first and second shutter members 51 and 61 toward their normal, relaxed (closed) position when no plug blades are present.

The resiliency of the first arm 53 of the first shutter member 51 facilitates manufacturing of the first shutter member. Preferably, the first arm 53 of the first shutter member includes a semi-living hinge. A semi-living hinge has a wall thickness that is greater than that allowed for a living hinge. For example, the wall thickness at the hinge point of the semi-living hinge 54 may be approximately 0.025-0.030 inches thick. A living hinge at this point would have a thickness between 0.012-0.018 inches. Thus, the wall thickness at the hinge point for the semi-living hinge is approximately twice the wall thickness of a living hinge. The semi-living hinge provides less stress in the first arm 53 of the first shutter member 51. To mold the first and second arms 53 and 55, a mold member, such as a piece of steel, is disposed between the first and second arms during the molding process. By providing the first arm 53 with a semi-living hinge 54, the first arm flexes easily to remove the first shutter member 51 from the mold to capture the geometry of the first shutter member as a single part. This simplifies the molding process of the first shutter member and eliminates the need to mold an additional part for the tamper resistant assembly.

Figure 17:
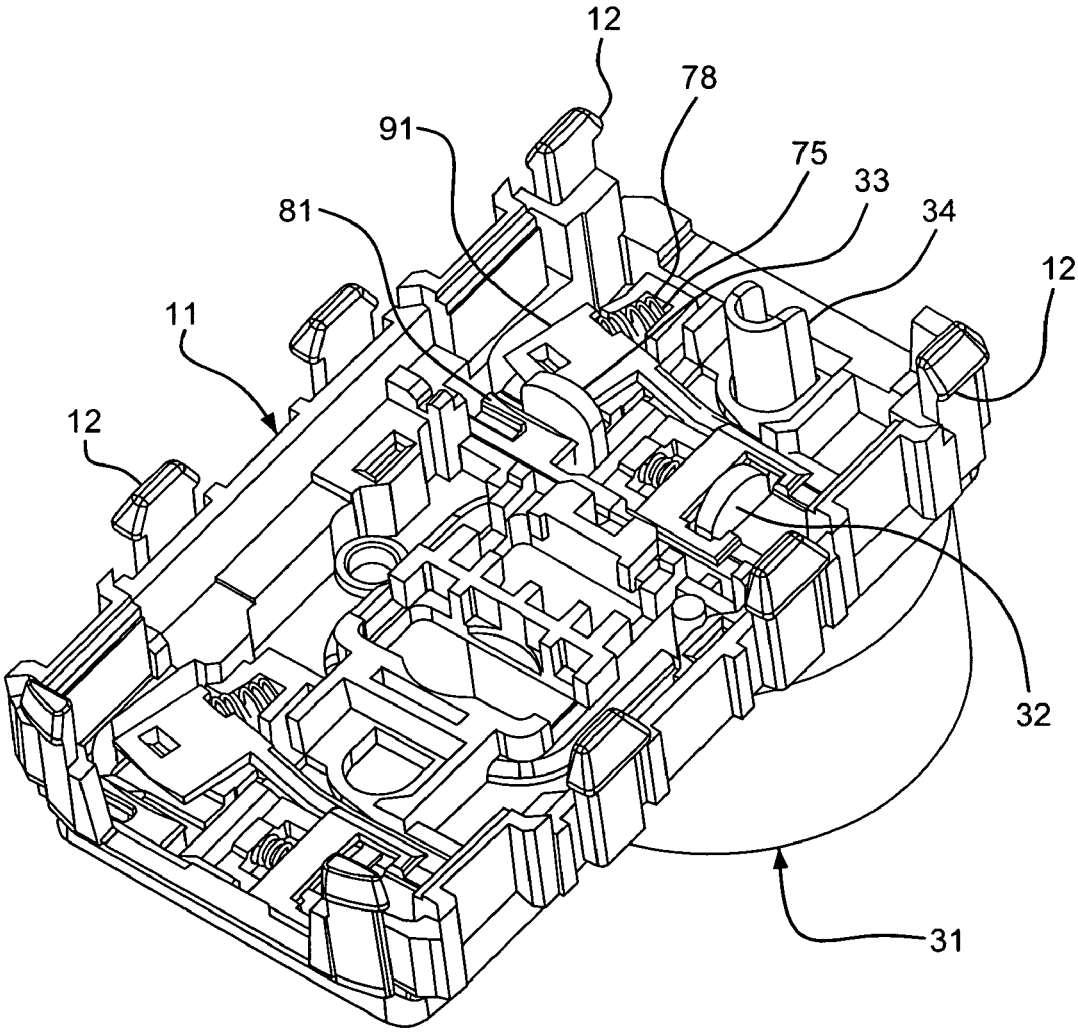
FIG. 17 is a rear perspective view of a 20 amp plug being correctly inserted in the front cover of the electrical receptacle of FIG. 1 in which a back housing of the electrical receptacle has been removed for clarity.

The distal end 81 of the first arm 53 and the distal end 91 of the second arm 55 of the first shutter member 51 abut to form a blocking portion having a blade entry slot 82, as shown in FIGS. 3 and 4, through which a properly inserted plug blade 33 passes, as shown in FIG. 17. First surface 82 of the distal end 81 of the first arm 53 and second surface 92 of the second arm 55 are preferably inclined to facilitate and guide a properly inserted blade to the blade entry slot 82. The distal end 81 of the first arm 53 has an upper groove 83 and a lower groove 85 that define a substantially H-shaped member, as shown in FIGS. 3 and 4. The lower groove 85 is adapted to be received by a protrusion 46 on the slide pad member 41 as shown in FIG. 15, thereby limiting the first arm 53 to lateral movement. To further facilitate limiting the first arm 53 to lateral movement, the upper groove 83 may also receive a rib connected to the front cover 11.

Figure 18:
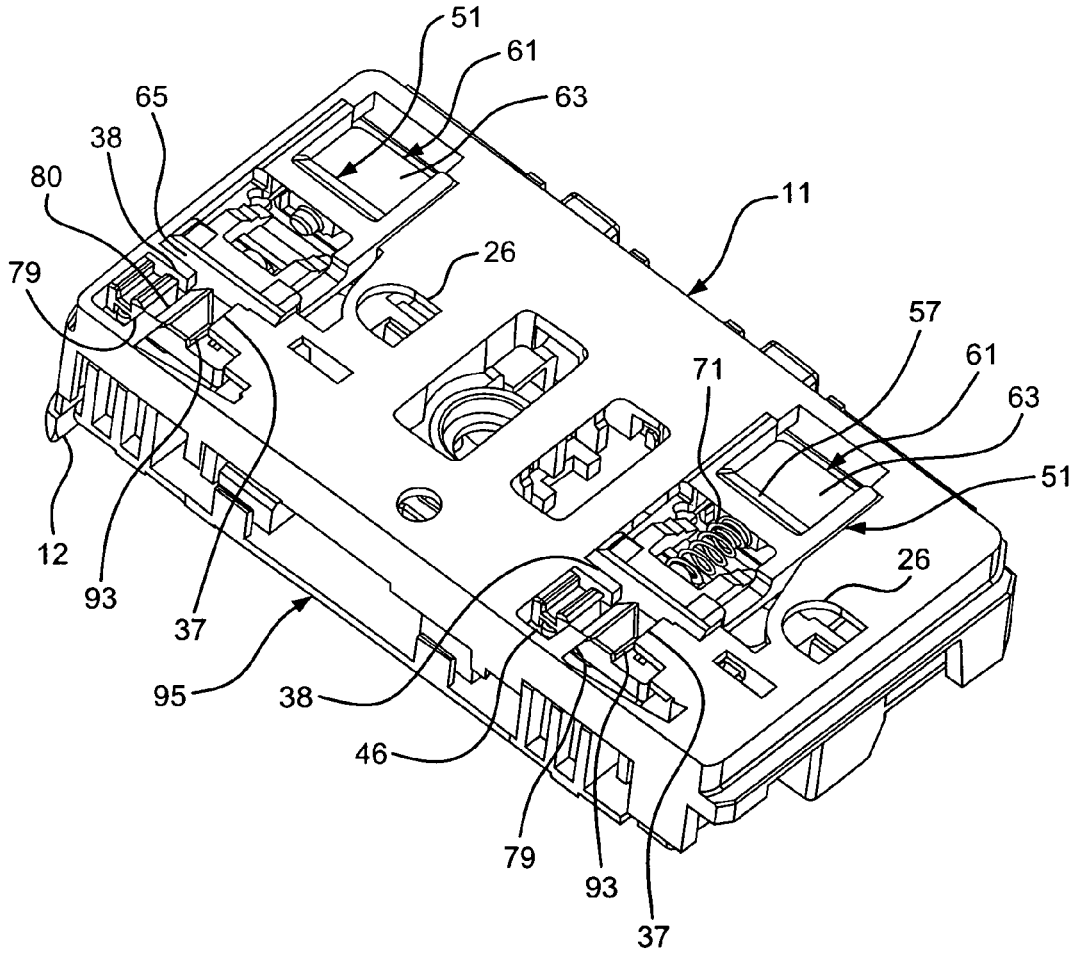
FIG. 18 is a front perspective view in partial cross section of the tamper resistant assembly of the present invention disposed in the front cover.

A distal end 91 of the second arm 55 of the first shutter member 51 has a protrusion 93 adapted to engage a stop 37 of the front cover 11, as shown in FIG. 18. The stop 37 prevents pivotal movement of the second arm 55 when a foreign object or blade is inserted through the second portion 28 of the second opening 25 in the front cover 11, thereby preventing access to the electrical contact 19. The distal end 91 of the second arm 55 pivots away from the distal end 81 of the first arm 53 to form a gap in the blade entry slot 82 such that an inserted plug blade 33 may pass therebetween, as shown in FIG. 17.

Figure 11:
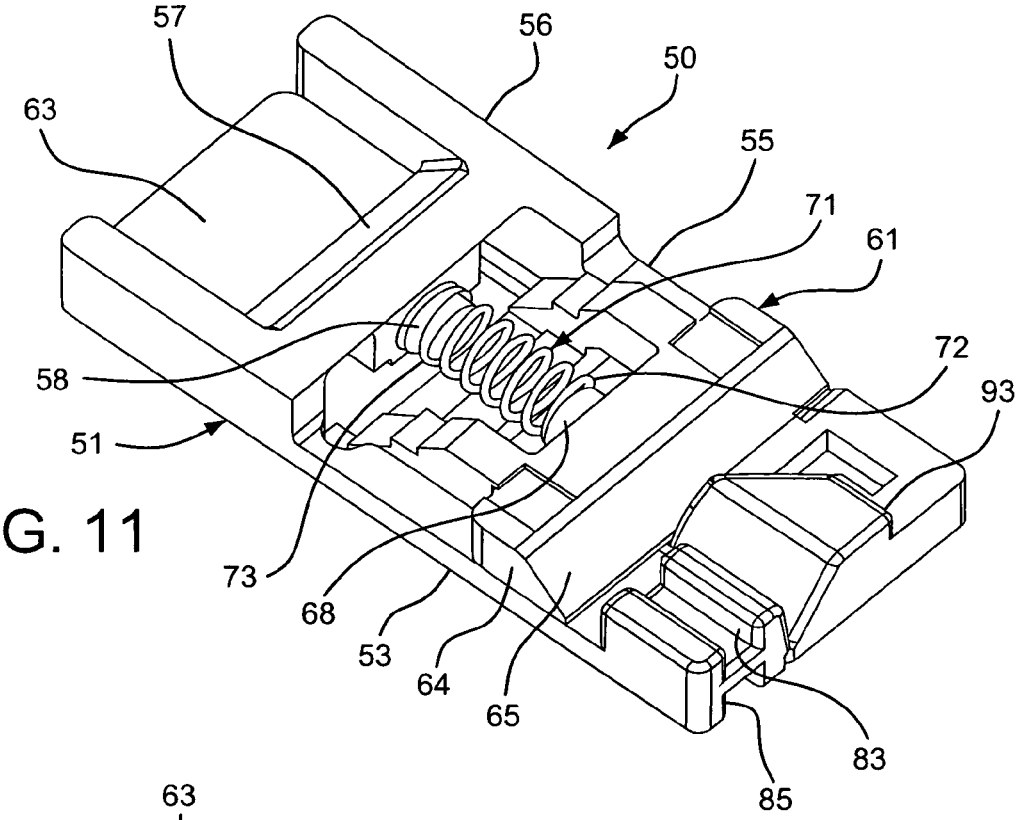
FIGS. 11 and 12 are upper and lower perspective views, respectively, of the first and second shutter members of FIGS. 3-6 assembled with a spring disposed therebetween.
Figure 13:
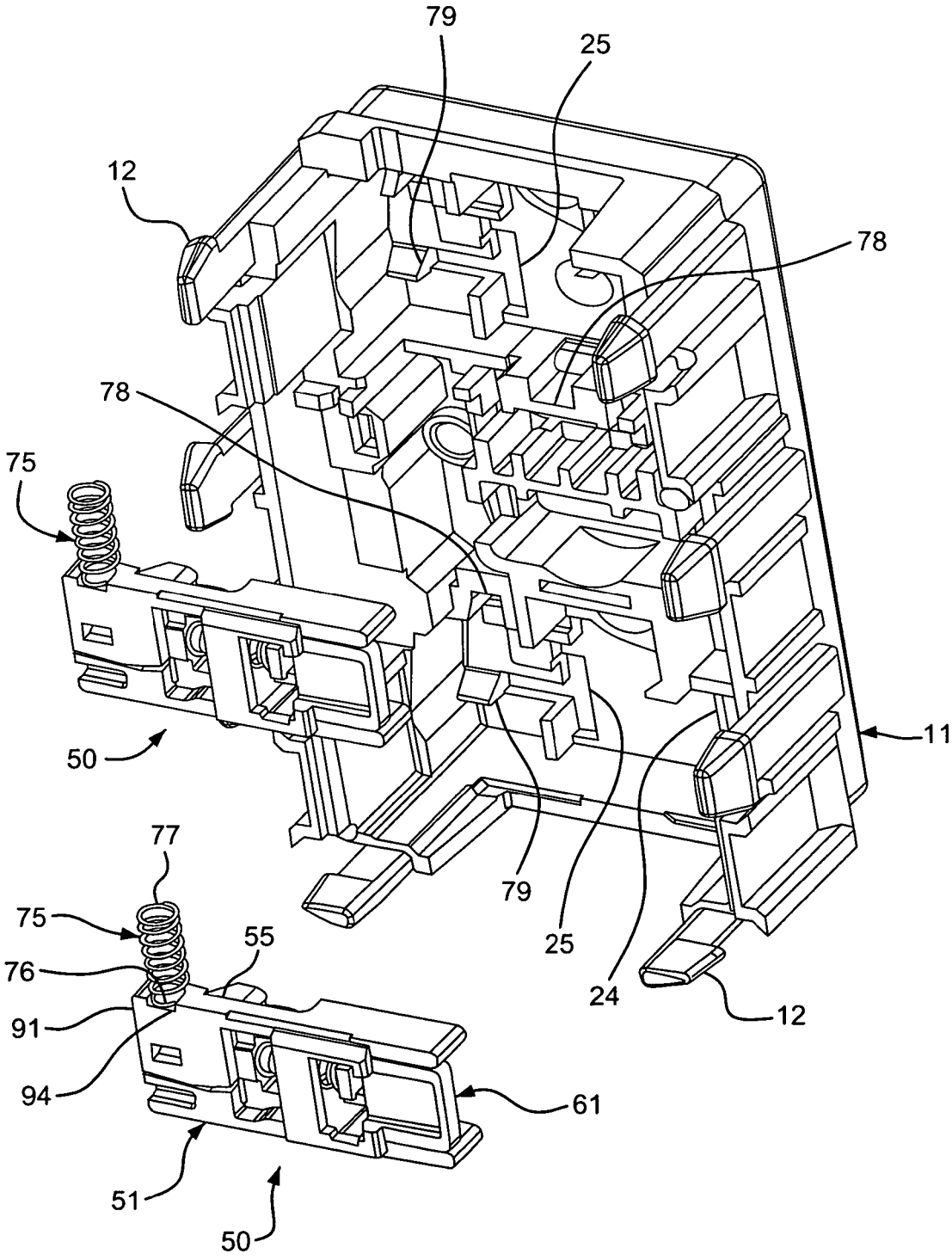
FIG. 13 is a rear perspective view of the assembled first and second shutter members of FIGS. 7 and 8 prior to disposal in a front cover of an electrical receptacle of FIGS. 1 and 2.

The blocking portion of the first shutter member 51 has a first blocking portion 87 on the first arm 53 and a second blocking portion 97 on the second arm 55, as shown in FIG. 3. When a foreign object or single blade is inserted through the first portion 27 of the second opening 25, access to the electrical contact 18 is prevented by the first and second blocking portions 87 and 97 of the first shutter member 51. Preferably, the first and second blocking portions 87 and 97 are angled to guide an inserted foreign object or blade into the blocking portion and to prevent such an inserted foreign object or blade from bypassing the blocking portion to access the electrical contact 18. When the first and second shutter members 51 and 61 are in the closed position, as shown in FIG. 11, the second cam body 64 of the second shutter member 61 covers the first and second blocking portions 87 and 97. A rib 79 connected to the front cover 11, as shown in FIG. 13, is disposed between the surfaces 82 and 92 at the distal ends 81 and 91 of the first and second arms 53 and 55 to facilitate lateral movement of the first shutter member 51 between closed and open positions.

Figure 12:
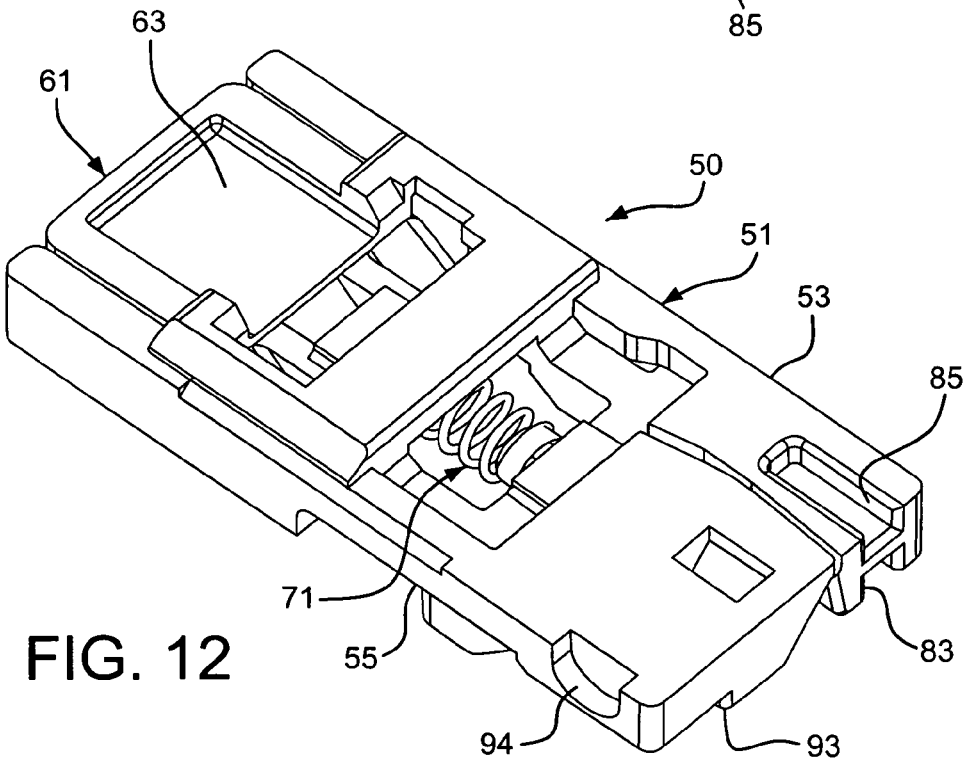

A second spring 75 is adapted to be disposed between the distal end 91 of the second arm 55 and the front cover 11 of the electrical receptacle 10, as shown in FIG. 17. The distal end 91 of the second arm 55 preferably has a recess 94, as shown in FIGS. 12 and 13, adapted to receive a first end 76 of the second spring 75. A second end 77 of the second spring 75 is adapted to be received by a wall 78 of the front cover 11, as shown in FIG. 17.

Figure 5:
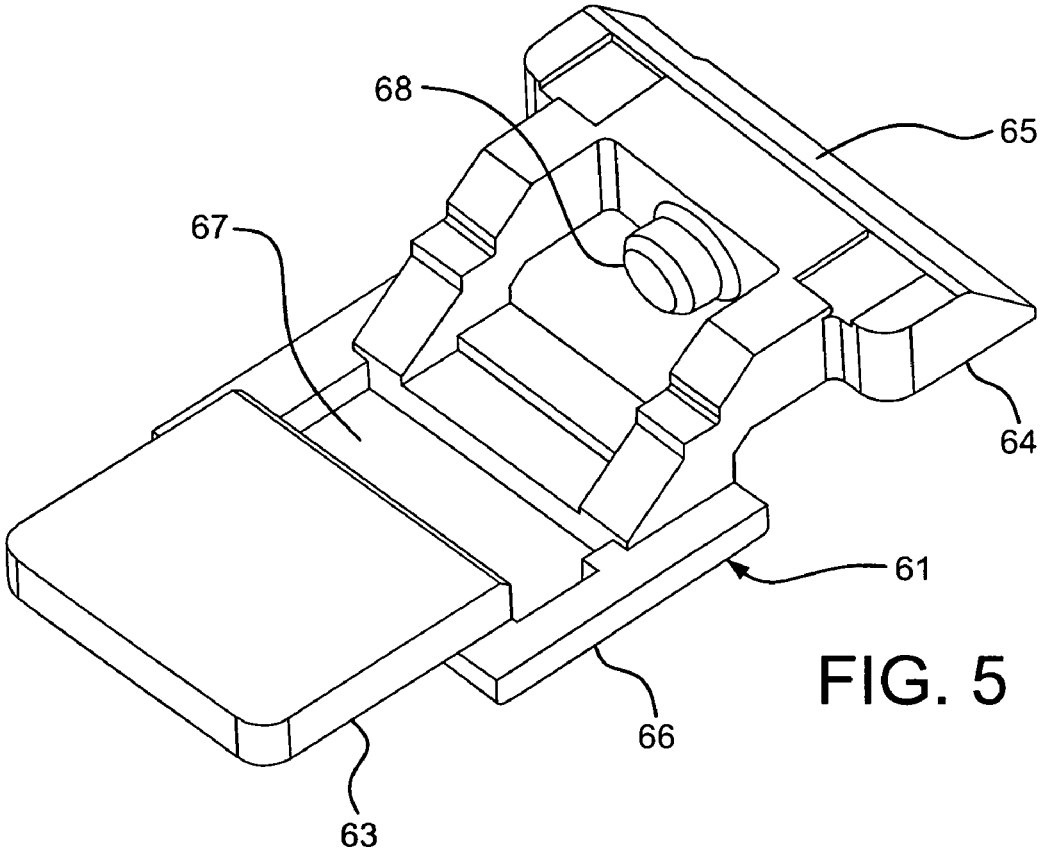
FIGS. 5 and 6 are upper and lower perspective views, respectively, of a second shutter member of a tamper resistant assembly according to an exemplary embodiment of the present invention.
Figure 6:
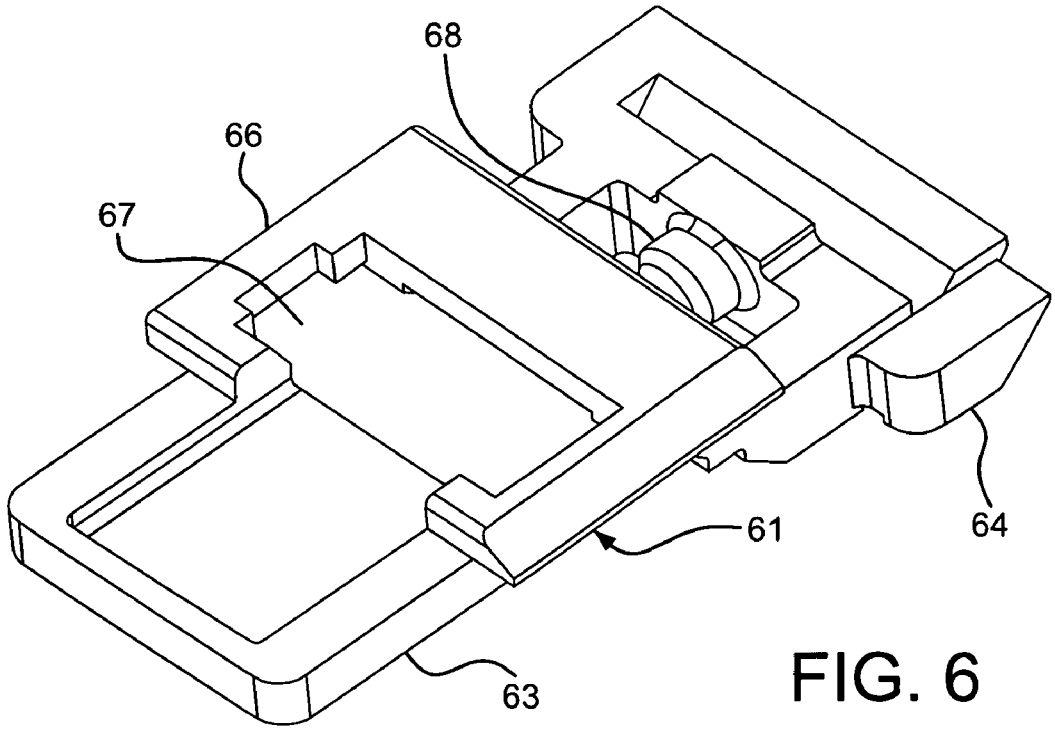
Figure 7:
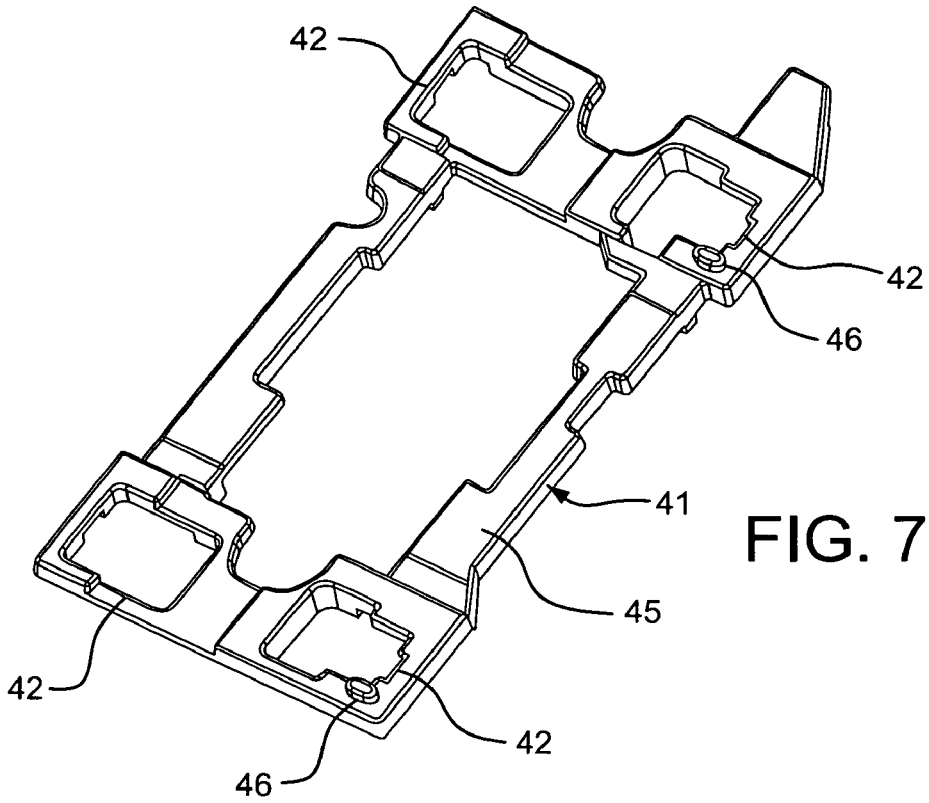
FIGS. 7 and 8 are upper and lower perspective views, respectively, of a slide pad member of a tamper resistant assembly according to an exemplary embodiment of the present invention.
Figure 8:
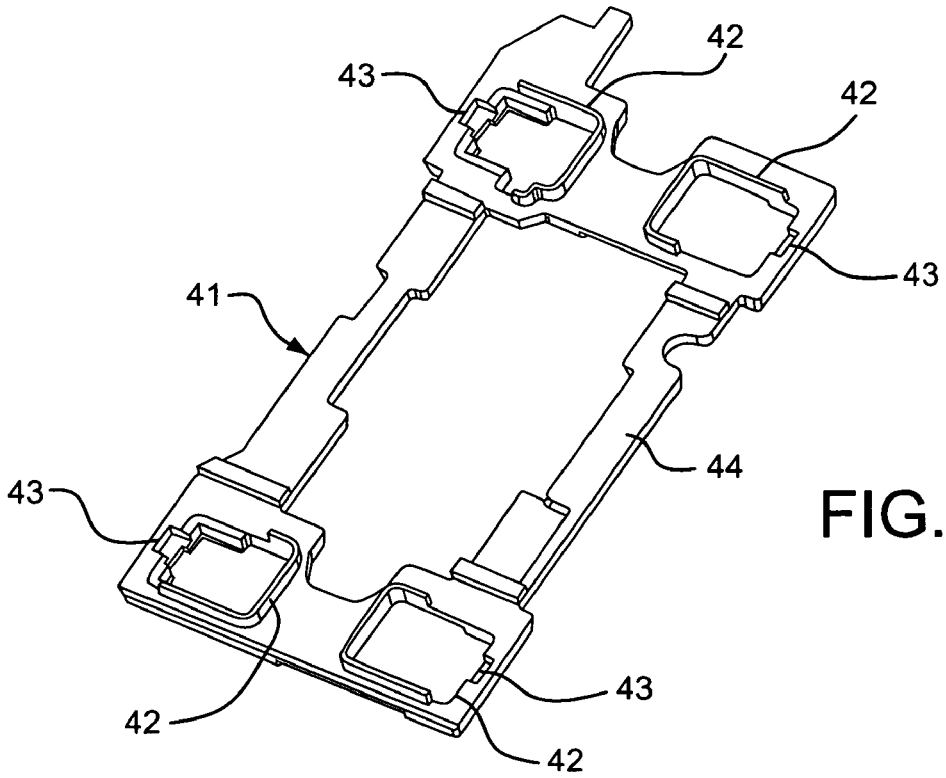

As shown in FIGS. 5 and 6, the second shutter member 61 has at one end thereof a blocking body 63, which is substantially planar and faces toward the first opening 24 in the front cover 11 of the electrical receptacle 10 through which a plug blade is inserted. The blocking body 63 is positioned below the first opening 24 when the first and second shutter members 51 and 61 are in the closed position to prevent a foreign object or a single plug blade inserted therethrough from contacting the electrical contact 18. The blocking body 63 is disposed behind the cam surface 57 of the first shutter member 51 when the first and second shutter members 51 and 61 are in the closed position, as shown in FIG. 11. Thus, when a foreign object or a single plug blade is inserted through the first opening 24, the object engages the cam surface 57 and moves the first shutter member 51. However, because nothing engages the second cam surface 65, the second shutter member 61 does not move such that the inserted foreign object contacts the blocking body 63 of the second shutter member 61. When the foreign object is removed, the spring member 71 returns the first shutter member 51 to its original position.

The second shutter member 61 also includes a second cam body 64 having an inclined second cam surface 65 formed thereon. The second cam surface 65 faces away from the blocking body 63. The second cam body 64 is connected to the blocking body 63 by a connecting body 66. A second opening 67 is disposed in the connecting body 66 of the second shutter member 61. Preferably, the second opening 69 is substantially rectangular. A generally cylindrical guide rod 68 extends outwardly from the second cam body 64 toward the blocking body 63 and is adapted to receive an end 72 of the compression coil spring 71, which urges the first and second shutter members 51 and 61 toward their closed position when no plug blades are present.

The shutter assembly 50 is shown assembled in FIGS. 11-13. The connecting body 66 and blocking body 63 of the second shutter member 61 are disposed behind the first cam body 56 of the first shutter member 51 when the first and second shutter members 51 and 61 are in the closed position. The first and second blocking portions 87 and 97 of the first shutter member 51 are disposed behind the second cam body 64 of the second shutter member 61 when the first and second shutter members 51 and 61 are in the closed position. Additionally, there is no gap in the blade entry slot 82 defined by the first and second arms 53 and 55 when the first and second shutter members 51 and 61 are in the closed position.

Figure 9:
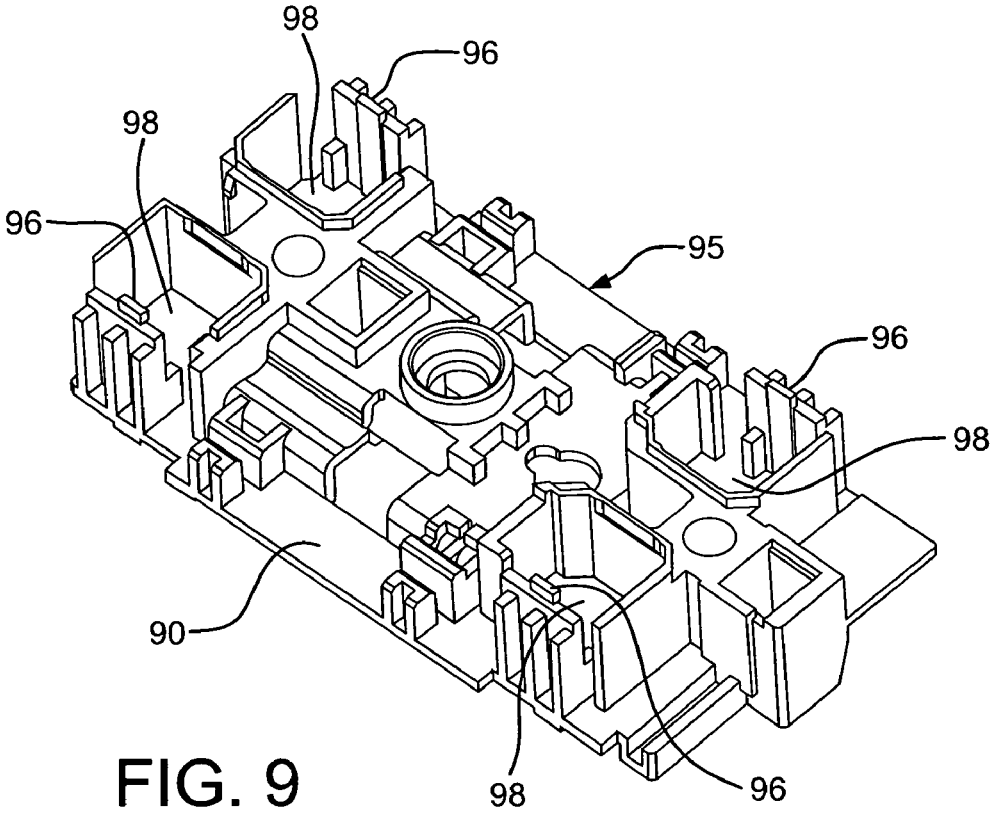
FIGS. 9 and 10 are upper and lower perspective views, respectively, of a barrier housing of a tamper resistant assembly according to an exemplary embodiment of the present invention.
Figure 10:
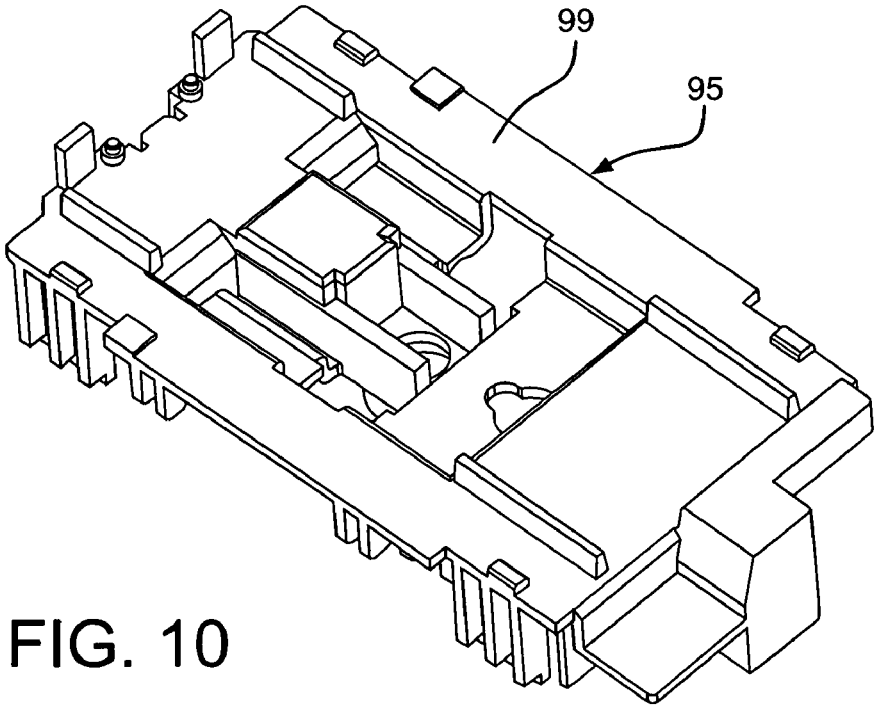

A barrier housing 95 is disposed in the back housing 13, as shown in FIGS. 9, 10 and 14. The barrier housing 95 has a plurality of tabs 96 to locate the slide pad member 41. The electrical contact assemblies 30 are disposed on an upper surface 90 of the barrier housing 95, as shown in FIG. 14. Contact areas 98 of the barrier housing 95 receive the electrical contacts 18 and 19 of the electrical contact assemblies 30, as shown in FIG. 14. The barrier housing 95 separates the hot, neutral and ground contacts. The lower surface 99 of the barrier housing 95 insulates the components disposed on a printed circuit board (not shown) mounted below in the back housing 13.

The slide pad member 41 is substantially rectangular in top plan view and has slots 43 formed in a lower surface 44 adapted to receive corresponding tabs 96 of the barrier housing 95, as shown in FIGS. 7-10, 14 and 15. The slots 43 locate the slide pad member 41 on the barrier housing 95, as well as substantially preventing movement of the slide pad member 41 on the barrier housing 95. Openings 42 proximal the corners of the slide pad member 41 are adapted to provide access to the electrical contacts 18 and 19 disposed in the barrier housing 95, as shown in FIG. 14. Protrusions 46 extend outwardly from an upper surface 45 of the slide pad member 41 and are adapted to engage an end of the second arm 55 of the first shutter member. The upper surface of the slide pad member 41 is substantially flat and smooth, providing a good surface for the sliding action of the shutter members 51 and 61 as a plug is inserted.

Referring to FIGS. 13-15, the first cam body 56 and the first cam surface 57 are disposed adjacent the first opening 24 such that a plug blade inserted therein contacts the cam surface 57, thereby moving the first shutter member 51 to the right as viewed from the front of the electrical receptacle 10. The second cam body 64 and the second cam surface 65 are disposed adjacent the second opening 25 such that a plug blade inserted therein contacts the cam surface 65, thereby moving the second shutter member 61 to the left as viewed from the front of the electrical receptacle 10.

The slide pad member 41 and the first and second shutter members 51 and 61 are preferably made of a thermoplastic, such as nylon or acetal. More preferably, a glass filled nylon is used to increase the structural strength and rigidity of the manufactured parts.

Assembly and Operation

The tamper resistant assembly is assembled by passing the second cam body 64 and the connecting body 66 of the second shutter member through the opening 52 of the first shutter member 51, as shown in FIGS. 11 and 12. The first and second shutter members are then aligned and the spring 71 is disposed therebetween. The spring 71 is then compressed and inserted between the first and second shutter members 51 and 61. A first end 72 of the spring 71 is connected to the guide rod 68 of the second shutter member 61, and the second end 73 of the spring 71 is connected to the guide rod 58 of the first shutter member 51 biasing the shutter member toward their closed positions. This shutter assembly 50, as shown in FIGS. 11-13, is then disposed in the front cover 11, as shown in FIG. 13, and the second spring 75 is disposed between the distal end 91 of the second arm 55 and the wall 78 of the front cover 11. A rib 38 connected to the front cover 11 is disposed between the distal end 81 of the first shutter arm 53 of the first shutter member 51 and the second cam body 64 of the second shutter member 61 to facilitate locating the shutter assembly 50 to the front cover 11.

The slide pad member 41 is then disposed on the barrier housing 95, which is connected to the back housing 13, such that the slots 43 formed in the lower surface 44 of the slide pad member 41 engage corresponding tabs 96 of the barrier housing 95, as shown in FIG. 14. The arms 12 of the front cover 11 are then engaged with the receptacles 14 of the back housing 13 to secure the front cover 11 to the back housing 13. The protrusion 46 of the slide pad member 41 is thus received by the lower groove 85 of the distal end 81 of the first arm 53, as shown in FIG. 15.

The electrical receptacle 10 includes the front cover 11 having a first opening 24 therein adapted to receive a first plug blade 22 of plug 21 and a second opening 24 adapted to receive a second plug blade 23 lying in a plane substantially parallel to the plane containing the plug blade passing through the first opening 24, as shown in FIG. 1. The second opening 24 is also adapted to receive a plug 31 having a second plug blade 33 that is substantially perpendicular to the first plug blade 32 passing through the first opening 24, as shown in FIG. 2.

When plug blades 22 and 23 of the plug 21 are inserted through first and second openings 24 and 25, respectively, as shown in FIG. 1, the blades 22 and 23 contact cam surfaces 57 and 65, respectively. As plug blade 22 contacts first cam surface 57, the first shutter member 51 is moved to the right as viewed in FIG. 16, thereby moving the first and second blocking portions 87 and 97 to the right so that the first and second blocking portions 87 and 97 no longer obstruct the path between the front cover second opening 25, the first shutter member opening 52 and the opening 42 in the slide pad member 41 such that the second blade 23 may access the electrical contact 19. Lateral movement of the first shutter member 51 is guided by the protrusion 46 received in the lower groove 85 at the distal end 81 of the first arm 53. Additionally, a rib 79 (FIG. 13) on the front cover 11 disposed between the distal ends 81 and 91 of the first and second arms 53 and 55 further facilitates lateral movement of the first shutter member 51 between closed and open positions. As plug blade 23 contacts second cam surface 65, the second shutter member 61 is moved to the left as viewed in FIG. 16, thereby moving the second blocking body 63 to the left such that the second blocking body 63 no longer obstructs the path between the front cover first opening 24, the second shutter member opening 67 and the opening 42 in the slide pad member 41 such that the first blade 22 may access the electrical contact 18. When plug blades 22 and 23 are removed, the first spring 71 returns the first and second shutter members 51 and 61 to the closed position.

When plug blades 32 and 33 of the plug 31 are inserted through first and second openings 24 and 25, respectively, as shown in FIG. 2, the blades 32 and 33 contact cam surfaces 57 and 65, respectively. As plug blade 32 contacts first cam surface 57, the first shutter member 51 is moved to the right as viewed in FIG. 16, thereby moving the protrusion 93 at the distal end 91 of the second arm 55 beyond the stop 37 of the front cover, thereby allowing for pivotal movement of the second arm 55. Thus, when the blade 33 is inserted through the second portion 28 of the second opening 25, the blade 33 engages the surfaces 82 and 92 at the distal ends of the first and second arms and is guided toward the blade entry slot 80. Because the protrusion 93 has moved beyond the stop 37 of the front cover, the blade 33 passes through the blade entry slot, as shown in FIG. 17, thereby causing the second arm 55 to pivot away from the first arm 53. Therefore, the blade 33 may access the electrical contact 19 by passing through the blade entry slot 80 and the opening 42 in the slide pad member 41. Furthermore, the blade 33 also contacts the second cam surface 65 and moves the second shutter member 61 to the left as viewed in FIG. 16, thereby moving the second blocking body 63 to the left such that the second blocking body 63 no longer obstructs the path between the front cover first opening 24, the second shutter member opening 67 and the opening 42 in the slide pad member 41 such that the first blade 32 may access the electrical contact 18. When plug blades 32 and 33 are removed, the first spring 71 returns the first and second shutter members 51 and 61 to the closed position. Furthermore, when the blade 33 is removed, the second spring 75 returns the second arm 55 to the closed position, thereby providing a blade entry slot 80 with no gap therebetween.

During the insertion of the plug blades 22 and 23 (or 32 and 33), guide rods 58 and 68 move toward each other, thereby compressing the first spring 71. Upon removal of the plug blades, the first spring 71 returns the shutter members 51 and 61 to the closed position, as shown in FIG. 15.

However, insertion of a foreign object, such as a single blade-like article, in either the first or second openings 24 and 25 is prevented from accessing the conductive elements 18 and 19 by the tamper resistant assembly. For example, as shown in FIG. 16, an object 20 inserted in the first portion 27 of the second opening 25 in the front cover 11 engages the cam surface 65 of the second cam body 64 of the second shutter member 61, thereby moving the second shutter member 61 to the left. However, the object 20 is prevented from accessing the conductive element 19 (FIG. 14) because first and second blocking portions 87 and 97 (FIG. 3) of the first shutter member 51 blocks access thereto. Similarly, insertion of the foreign object in the first opening 24 is prevented from accessing the conductive element 18 by the tamper resistant assembly. When the foreign object is inserted in the first opening 24 in the front cover 11, the foreign object engages the first cam surface 57 of the first shutter member 51, thereby moving the first shutter member 51 to the right as viewed in FIG. 16. However, the foreign object is prevented from accessing the conductive element 18 because the blocking body 63 of the second shutter member 61 blocks access thereto. Thus, access to the conductive elements 18 and 19 in the electrical receptacle 10 is prevented unless both first and second shutter members 51 and 61 are engaged and moved by a correctly inserted plug 21 and 31, as shown in FIGS. 1 and 2.

When a foreign object is inserted in the second portion 28 of the second opening 25 in the front cover 11, the foreign object is prevented from accessing the conductive element 19 by the tamper resistant assembly. The inserted object contacts the surfaces 82 and 92 at the distal ends 81 and 91 of the first and second arms 53 and 55 of the first shutter member 51 and is guided to the blade entry slot 80. However, the first and second arms 53 and 55 forming the blade entry slot 82 are prevented from separating. The protrusion 46 of the slide pad member 41 received in the lower groove 85 of the first arm 53 prevents pivotal movement of the first arm 53. The stop 37 of the front cover 11 prevents pivotal movement of the second arm 55 when the first shutter member is in the closed position (the first shutter member is in the closed position because no object is inserted in the first opening 24 in the front cover 11 to engage the first cam surface 57 to laterally move the first shutter member 51). Thus, both the first and second arms 53 and 55 are prevented from pivotal movement, such that the foreign object inserted through the second portion 28 of the second opening 25 in the front cover 11 is prevented from accessing the conductive element 19.

While one advantageous embodiment has been chosen to illustrate the invention, it will be understood by those skilled in the art that various changes and modifications may be made therein without departing from the scope of the invention as defined in the appended claims.

What is claimed is:

1. An electrical receptacle, comprising:
a front cover;
a back housing secured to said front cover; and
a tamper resistant assembly disposed between the front cover and the back housing, including
a barrier housing connected to said back housing;
a slide pad member connected to said barrier housing;
first and second shutter members slidably disposed on said slide pad member, said first and second shutters being independently and relatively movable between open and closed positions; and
a first spring disposed between and biasing said first and second shutter members toward closed positions thereof.

2. The electrical receptacle of claim 1, wherein
the first shutter member has first and second arms extending from a first cam surface; and
the second shutter member has a blocking body connected to a second cam surface.

3. The electrical receptacle of claim 2, wherein
when said first shutter member moves from said closed to said open position, said first arm moves laterally and said second arm moves laterally and pivotally.

4. The electrical receptacle of claim 2, wherein
when said first and second shutter members are in said closed position, said blocking body of said second shutter member is behind said first cam surface to prevent insertion of a foreign object past said second shutter member.

5. The electrical receptacle of claim 1, wherein
a second spring is disposed between and biasing said second arm of said first shutter member away from a wall of said front cover.

6. The electrical receptacle of claim 1, wherein
a plurality of tabs extend from said barrier housing and are received by corresponding slots in said slide pad.

7. The electrical receptacle of claim 1, wherein
an electrical contact assembly is disposed on an upper surface of said barrier housing.

8. The electrical receptacle of claim 7, wherein
said slide pad has a plurality of openings to access electrical contacts of said electrical contact assemblies pass when said slide pad is disposed on said barrier housing.

9. An electrical receptacle, comprising:
a front cover;
a back housing secured to said front cover; and
a tamper resistant assembly disposed between the front cover and the back housing, including
a barrier housing connected to said back housing;
a slide pad member connected to said barrier housing;
a first shutter member slidably disposed on said slide pad member and having first and second arms extending from a first cam surface;
a second shutter member slidably disposed on said slide pad member and having a blocking body connected to a second cam surface, said first and second shutter members being independently and relatively movable between open and closed positions; and a first spring disposed between and biasing said first and second shutter members toward closed positions thereof; and a second spring disposed between and biasing said second arm of said first shutter member away from a wall of said front cover.

10. The electrical receptacle of claim 9, wherein a plurality of tabs extend from said barrier housing and are received by corresponding slots in said slide pad.

11. The electrical receptacle of claim 9, wherein an electrical contact assembly is disposed on an upper surface of said barrier housing.

12. The electrical receptacle of claim 11, wherein said slide pad has a plurality of openings to access electrical contacts of said electrical contact assemblies pass when said slide pad is disposed on said barrier housing.

13. An electrical receptacle, comprising:

a front cover having a rib connected thereto;

a back housing secured to said front cover; and a tamper resistant assembly disposed between the front cover and the back housing, including a barrier housing connected to said back housing;

a slide pad member connected to said barrier housing and having a protrusion connected thereto;

a first shutter member slidably disposed on said slide pad member and having first and second arms extending from a first cam surface, said first shutter member being movable between open and closed positions and said first arm including a semi-living hinge;

a second shutter member slidably disposed on said slide pad member and having a blocking body connected to a second cam surface, said second shutter member being movable between open and closed positions; and a first spring disposed between and biasing said first and second shutter members toward closed positions thereof; and a second spring disposed between and biasing said second arm of said first shutter member away from a side wall of said front cover, wherein said protrusion connected to said slide pad member engages said first arm of said first shutter member to guide lateral movement of said first shutter member between closed and open positions and said rib on said front cover is disposed between said first and second arms of said first shutter member to guide lateral movement of said first shutter member between closed and open positions.

14. The electrical receptacle of claim 13, wherein a plurality of tabs extend from said barrier housing and are received by corresponding slots in said slide pad.

15. The electrical receptacle of claim 13, wherein an electrical contact assembly is disposed on an upper surface of said barrier housing.

16. The electrical receptacle of claim 15, wherein said slide pad has a plurality of openings to access electrical contacts of said electrical contact assemblies pass when said slide pad is disposed on said barrier housing.

17. The electrical receptacle of claim 13, wherein an electrical contact assembly is disposed on an upper surface of said barrier housing.

* * * * *